US006565702B1

(12) United States Patent
Forsyth et al.

(10) Patent No.: US 6,565,702 B1
(45) Date of Patent: May 20, 2003

(54) CHAMOIS FOR CYCLING PANTS AND METHOD OF MAKING

(75) Inventors: Robbin Douglas Forsyth, Boulder, CO (US); Jonathan Robert Knoll, Boulder, CO (US)

(73) Assignee: DashAmerica, Inc., Broomfield, CO (US)

( * ) Notice: Subject to any disclaimer, the term of this patent is extended or adjusted under 35 U.S.C. 154(b) by 0 days.

(21) Appl. No.: 10/012,922

(22) Filed: Oct. 22, 2001

(51) Int. Cl.[7] ..... A41D 1/08
(52) U.S. Cl. ..... 156/308.4; 156/93; 2/228
(58) Field of Search ..... 156/91, 92, 93, 156/308.2, 308.4, 309.9; 2/464, 466, 22, 467, 228, 23, 46, 215, 214, 238, 227, 267, 272; 450/122, 153, 156

(56) References Cited

U.S. PATENT DOCUMENTS

| | | | | |
|---|---|---|---|---|
| 4,805,243 A | | 2/1989 | Gibbens et al. | |
| 4,945,571 A | | 8/1990 | Calvert | |
| 4,961,233 A | | 10/1990 | Black | |
| 5,271,101 A | | 12/1993 | Speth et al. | |
| D360,971 S | | 8/1995 | Speth et al. | |
| 6,070,273 A | * | 6/2000 | Sgro | 2/455 |
| 6,345,396 B1 | * | 2/2002 | Schuler | 2/467 |
| 6,393,618 B2 | * | 5/2002 | Garneau | 2/228 |

* cited by examiner

*Primary Examiner*—Michael W. Ball
*Assistant Examiner*—Gladys Corcoran
(74) *Attorney, Agent, or Firm*—Holland & Hart LLP; Francis A. Sirr, Esq.

(57) ABSTRACT

A chamois for use within the seat area of a cycling garment includes a non-woven polyester interfacing or batting layer with a bottom surface that engages the cycling garment. The polyester layer provides a pad area for association with the buttocks of a cycling individual, two side pad areas for association with the upper inside thighs of the individual, and a pad area for association with the lower abdominal area of the individual. A thin and low hardness synthetic foam layer has a shape that complements the polyester layer, and a bottom surface thereof engages a top surface of the polyester layer. A thick, high hardness, synthetic foam layer is associated with the thin foam layer and occupies the pad area association with the buttocks. A synthetic leather layer has a shape that complements the shape of the polyester layer and a bottom surface thereof engages the top surface of the thin foam layer and the top surface of the thick foam layer.

16 Claims, 10 Drawing Sheets

CHAMOIS FOR CYCLING PANTS AND METHOD OF MAKING

BACKGROUND OF THE INVENTION

1. Field of the Invention

This invention relates to the field of garments to be worn by humans, and, more specifically, to a chamois for use within cycling pants or shorts to be worn by a male or a female while operating a bicycle.

2. Description of Related Art

Cycling pants/shorts of various configurations have become popular because they provide durability, they provide cushioning between the bicycle seat and the cyclist, and they minimize chafing of the body of the cyclist. Cycling pants conventionally include an inner pad that is located within the crotch and buttocks regions of the cyclist. Such pads have become known as chamois. While some chamois are composed of a number of pieces of flexible material that are stitched together, other chamois are formed of one piece of material.

For example, U.S. Pat. No. 4,961,233 (incorporated herein by reference) provides a two-layer, one-piece, heat-formed, and seamless chamois that includes an inner liner that faces the body of the cyclist and is made of a synthetic leather-like material, such as the brand Ultrasuede, and an outer synthetic fleece (polyester) member that is compressible. The inner liner and the synthetic fleece are adhesive bonded. The chamois is heat-formed to impart a generally form-fitting shape to the chamois wherein the edges of the chamois are over edge stitched. U.S. Design Patent DES. 360,971 also appears to be directed to the above anatomical seat pad.

U.S. Pat. No. 5,271,101 (incorporated herein by reference) provides cycling shorts that include a padded, three-layer, seat liner having a plurality of integrally formed and embossed break lines that create seamless indentations in the liner. These break lines are positioned such that the liner conforms to the anatomical profile of a cyclist who is positioned in a riding position on a bicycle. The liner is stitched or laminated to a body portion of the cycling pants. The liner includes a nylon tricot backing layer, a high-density polyurethane foam layer having open or closed cells that overlies the backing layer, and a synthetic suede covering layer that overlies the foam layer. The synthetic suede has a soft-napped side that faces the cyclist body. The embossed break lines are located in positions that represent pressure crease point of the seat liner when a cyclist is in a cycling position, and as the cyclist moves to other positions so as to prevent the bunching of excess material. The embossed break lines are formed without using stitching or sewn seams by heat molding the seat liner in a flat position.

U.S. Pat. No. 4,805,243 (incorporated herein by reference) describes bicycle shorts having openable pockets that removably receive seat and crotch synthetic foam pads having different thickness, thus adapting the padding to suit individual preferences.

U.S. Pat. No. 4,945,571 (incorporated herein by reference) provides bicycling shorts having a liquid-filled cushion for cushioning the rider thighs and buttocks, the cushion having a plurality of layers of material to facilitate perspiration wickage. The liquid cushions include overlying layers of a polyurethane material and water, non-freezable silicon or glycerin or mixtures thereof, oils or other slippery material.

While the art provides various type of cycling garments, as exemplified above, the need remains in the art for chamois and cycling garments that provide additional and improved benefits to the wearer as a bicycle is operated.

SUMMARY OF THE INVENTION

In embodiments of the present invention, a cycling chamois is provided that is formed of a number of flexible sheets or pieces of fabric or fabric and/or synthetic leather, and that includes strategically located pieces of relatively low-hardness foam and relatively high-hardness foam.

Chamois in accordance with the present invention provide support for the pelvic girdle of a male or a female cyclist. As is well known, the pelvic girdle (also known as the bony pelvis) is a basin-shaped complex of bones that connect the trunk and legs, that supports and balances the trunk, and that contains and supports the intestines, the urinary bladder, and the internal sex organs. The pelvic girdle includes paired hipbones that are connected in the front by the pubic symphysis and at the back by the sacrum, and includes the ischium on which weight falls in sitting wherein the ischial tuberosity is called the sitting bone.

When chamois constructed and arranged in accordance with the present invention is attached to the inside of a cycling garment, and when the garment is then worn by a cyclist, a garment-side of the chamois that faces the garment, and a body-side of the garment faces the cyclist body. In the following discussion, the side of the chamois that faces the garment will be called the bottom side or the garment-facing side of the chamois, and the side of the chamois that faces the cyclist body will be called the top side or the body-facing side of the chamois.

This invention provides embodiments of chamois wherein two pieces of relatively high-hardness foam are strategically located to accommodate the pelvic girdle of a male cyclist, and the invention provides other embodiments of the invention wherein one piece of relatively high-harness foam is strategically located to accommodate the pelvic girdle of a female cyclist.

More specifically, male-use chamois in accordance with the invention provide two physically-spaced pieces of relatively high-hardness foam that support the two buttocks of a male cyclist, while leaving a crotch space therebetween that is occupied by relatively low-hardness foam, whereas female-use chamois in accordance with the invention provides one piece of relatively high-hardness foam that supports both the buttocks and the crotch of a female cyclist.

Both a male-use chamois and a female-use chamois in accordance with the invention include a garment-facing cloth or cloth-like member whose outline forms the generally flat external shape or profile of the chamois. This garment-facing cloth member is adapted to physically engage the inner surface of a garment to be worn by a male/female cyclist.

This garment-facing cloth can be a woven cloth or a non-woven cloth, and it can be formed of a natural material or of a synthetic material, with polyester scrim being preferred, or with a non-woven interfacing or batting that is constructed of polyester fibers being preferred.

In use, this garment-facing cloth member is usually sewn to the inside of the seat area of a cycling garment.

Both a male-use chamois and a female-use chamois in accordance with the invention include a layer of relatively low-hardness foam whose outline forms the external shape or profile of the chamois.

In an embodiment of a male-use chamois in accordance with the invention, this layer of relatively low-hardness foam contains two buttocks-region holes that are filled by two pieces of relatively high-hardness foam. In another embodiment of a male-use chamois in accordance with the invention, this layer of relatively low-hardness foam is a continuous layer, and two physically-spaced pieces of relatively high-hardness foam overly two physically-spaced spaced buttocks regions on the layer of relatively low-hardness foam.

In an embodiment of a female-use chamois in accordance with the invention, this layer of relatively low-hardness foam contains one buttocks/crotch-region hole that is filled by one piece of relatively high-hardness foam. In another embodiment of a female-use chamois in accordance with the invention, this layer of relatively low-hardness foam is a continuous layer, and one piece of relatively high-hardness foam overlies the buttocks/crotch-region on the layer of relatively low-hardness foam.

As used herein, the term foam means a flexible, porous, natural or synthetic material whose volume contains a relatively high percentage of open or closed cells, and a relatively low percentage of the natural or synthetic material from which the foam is formed. While the spirit and scope of the invention is not to be limited thereto, in an embodiment of the invention, the low-hardness foam had a hardness of about 20 durometer (20 d) as measured by a durometer, and the relatively high-hardness foam had a hardness from about 40 d to about 90 d.

The term foam, as used herein, is also intended to mean a foamed or expanded plastic material that has been treated so as to cause air or gas bubbles or cells to be formed therein, these cells being either closed cells or open cells. However, within the spirit and scope of the invention, the term foam includes both presently known and after-developed equivalent means, such as gel-filled members and/or liquid-filled members. A non-limiting example is an open-cell polyurethane foam.

Both a male-use chamois and a female-use chamois in accordance with the invention include a garment-facing cloth or cloth-like member outline forms the external shape or profile of the chamois.

In an embodiment of a male-use chamois in accordance with the invention, this garment-facing cloth member is a continuous member. In another embodiment of a male-use chamois in accordance with the invention, this garment-facing cloth member contains two buttocks-region holes that are filled by two pieces of synthetic leather. In another embodiment of a male-use chamois in accordance with the invention, this garment-facing member is a continuous member, and two physically-spaced pieces of synthetic leather overly two physically-spaced buttocks regions on the body-facing cloth member.

In an embodiment of a female-use chamois in accordance with the invention, this garment-facing cloth member is a continuous member. In another embodiment of a female-use chamois in accordance with the invention, this garment-facing cloth member contains one buttocks/crotch-region hole that is filled by one piece of synthetic leather. In another embodiment of a female-use chamois in accordance with the invention, this garment-facing member is a continuous member, and one piece of synthetic leather overlies the buttocks/crotch-region on the body-facing cloth member.

This body-facing member can be a woven cloth or a non-woven cloth, and it can be formed of a natural material or of a synthetic material, with warp knit polyester tricot having a wicking finish being preferred.

In embodiments of the invention, a unitary chamois is formed of the various members by providing a heat-melting plastic ribbon the extends along the edges or boarders of the various member, such that the use of a heat press operates to melt the plastic ribbon and form a unitary chamois from the various chamois members.

As a feature of the invention, the chamois in accordance with this invention is formed into a single unit by the use of a bonding agent, and/or by the application of heat and pressure that operates to fuse the various pieces of the chamois together into a single unit.

As a feature of the invention, the application of heat and pressure to the chamois in accordance with this invention operates to form the chamois into a three-dimensional shape that generally matches the pelvic girdle of a male or a female.

While the invention will be described while making reference to the use of foam sheets, which may include open cell and/or closed-cell foams, the spirit and scope of the invention includes the use of both existing equivalent members and after-developed equivalent foam members. Examples of existing and equivalent foam members include, but are not limited to, gel-filled foam members, liquid-filled foam members, air-filled foam members, and combinations thereof, preferably to replace the above-descried thick foam sheets, but also to replace the above-described thin foam sheet.

DESCRIPTION OF THE PREFERRED EMBODIMENT

The present invention provides both male-use and female-use chamois for use within cycling garments in order to improve the comfort and the protection to the body of a male/female operating a bicycle.

Figure 1:
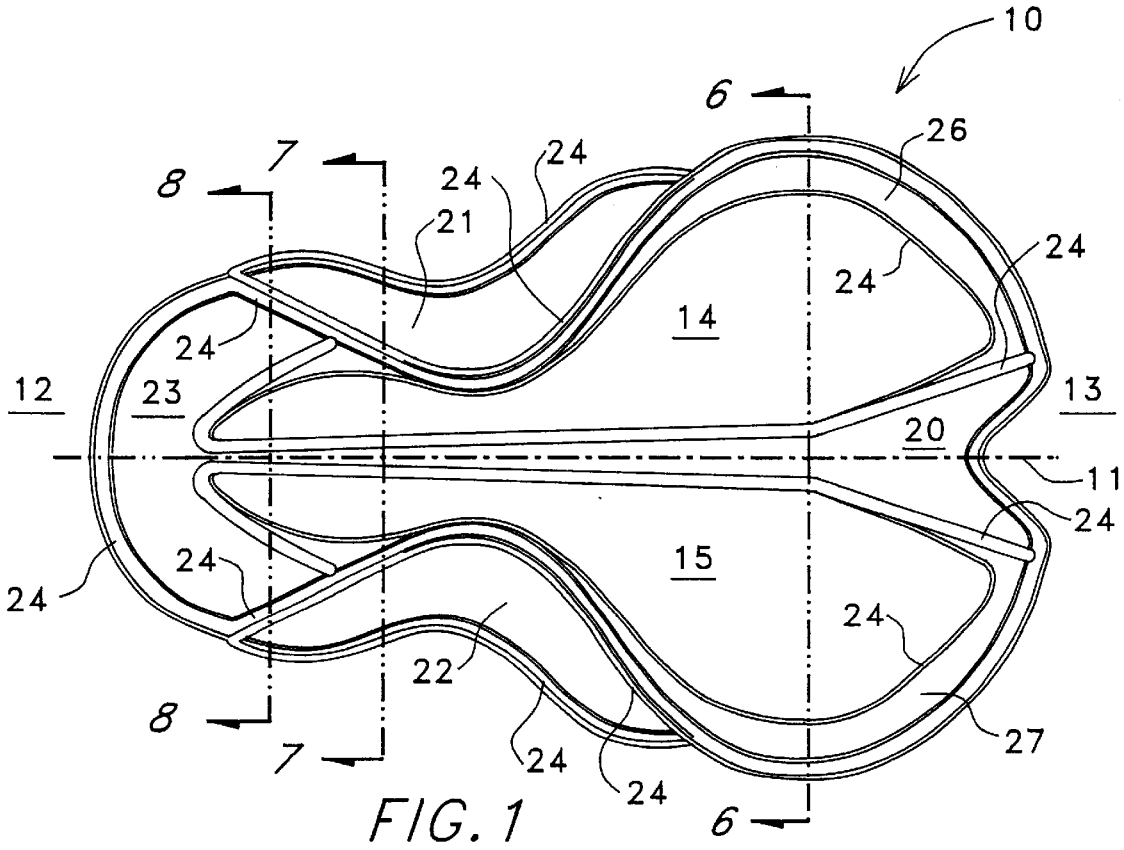
FIG. 1 is a top or body-side view of an embodiment of a chamois in accordance with the invention that is constructed and arranged for use by a male cyclist (i.e., the side of the chamois that faces the body of a cyclist).

FIG. 1 is a body-side view (i.e., the side of the chamois that faces the cyclist body) of a chamois 10 in accordance with the invention wherein chamois 10 is constructed and arranged for use by a male cyclist.

Chamois 10 is symmetrical about a front-to-back center-line 11, the forward end of chamois 10 being indicated by numeral 12, and the rearward end of chamois 10 being indicated by numeral 13.

Chamois 10 includes two relatively thick and high-hardness foam pad areas 14 and 15 that are established by two relatively high-hardness and generally tear-drop shaped pieces of foam 16 and 17 (see FIG. 6) that are contained within chamois 10. Teardrop shaped thick pad area 14 is adapted to support the right buttocks of a male cyclist, and teardrop shaped thick pad 15 is adapted to support the left buttocks of a male cyclist.

By way of a non-limiting example, relatively thick pad areas 14 and 15 are about 10 mm to about 14 mm thick, preferably about 12 mm thick, and they are formed of a relatively high density, polyester-based, expanded polyurethane foam having a hardness in the range of from about 40 durometer (40 d) to about 90 d, as measured by a durometer instrument.

In the art, normal density, polyester-based, expanded polyurethane foam is known to have a density of about 20 d, whereas relatively high density, polyester-based, expanded polyurethane foam has a hardness in the range of from about 40 d to about 90 d.

The term cloth or cloth-like member or sheet as used herein is intended to mean a pliant sheet material that is usually made by weaving, felting, or knitting natural or synthetic fibers and/or filaments.

While the term synthetic leather will be used in describing embodiments of the invention, it is intended that the use of a more expensive natural leather, rather than a synthetic material that is fabricated so as to imitate natural leather, is also encompassed by this term.

All chamois areas with the exception of thick pad areas 14 and 15 are formed by a sheet of relatively thin foam having a relatively low hardness. By way of a non-limiting example, these other pad areas are about 4 mm to about 8 mm thick, preferably about 6 mm thick, and the relatively thin foam that forms these other pad areas is expanded, polyester-based, polyurethane foam having a harness of about 20 d.

These other relatively thin and low-hardness chamois pad areas include a relatively narrow, forward tapered, and centrally-located thin foam pad 20 that generally corresponds to the crotch area of a male cyclist, a right side upper interior thigh pad 21, a left side upper interior thigh pad 22, a forward lower abdominal pad 23, and two rear pads 26 and 27 that generally surround the rear of thick and high-hardness form pads 14 and 15.

The various foam pad areas 14, 15, 20, 21, 22, 23, 26, and 27 of chamois 10 are surrounded or outlined by thin heat-formed lines 24 that are about 2 mm thick.

Figure 2:
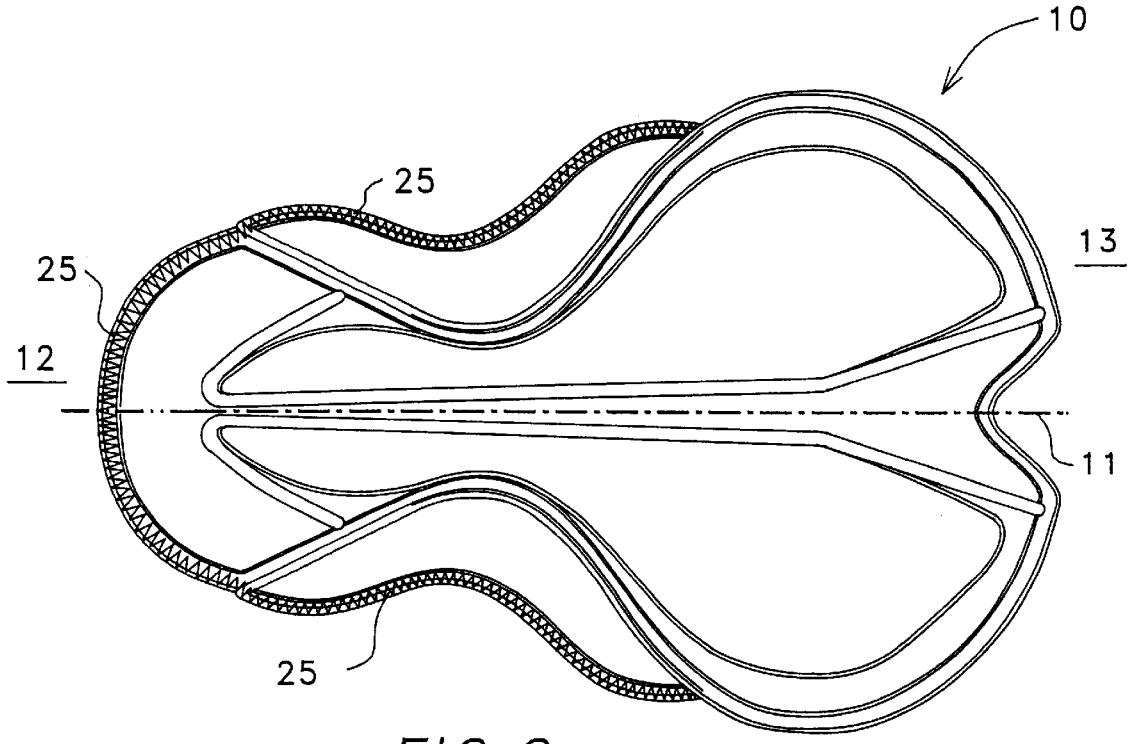
FIG. 2 is a bottom or garment-side view of the FIG. 1 male-cyclist chamois (i.e., the side of the chamois that faces a cycling garment), this figure also showing optional edge stitching that is provided along the forward and side edges of the chamois.

FIG. 2 is a garment-side view of chamois 10 (i.e., the side of chamois 10 that faces a cycling garment), this figure also showing the optional use of stitching 25 along the forward edge of chamois 10 and along the edges of the chamois' thigh portions.

Figure 6:
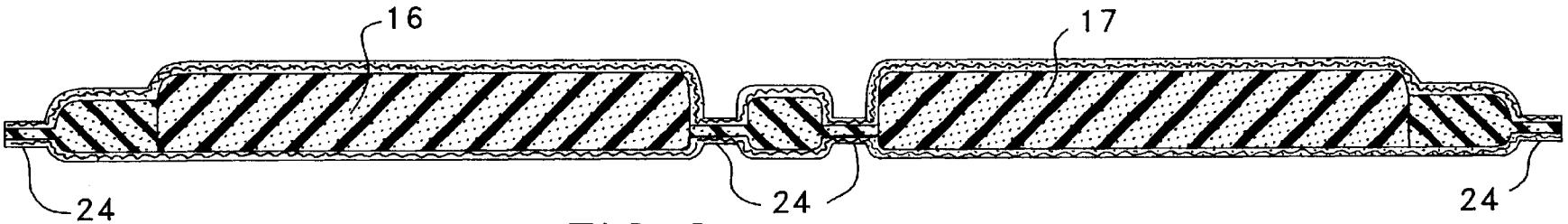
FIG. 6 is a section view of the chamois of FIGS. 1 and 3 taken on the line 6—6.
Figure 7:
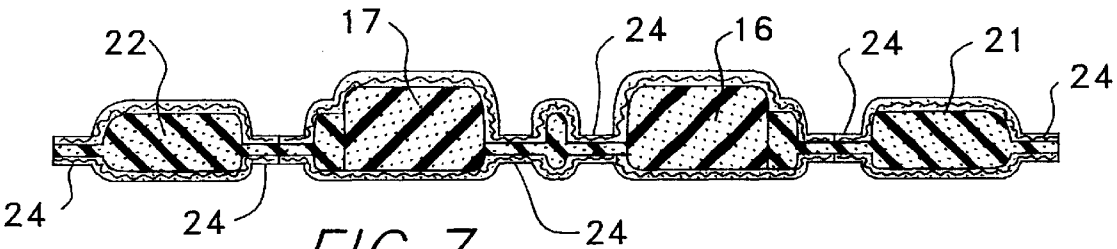
FIG. 7 is a section view of the chamois of FIGS. 1 and 3 taken on the line 7—7.
Figure 8:
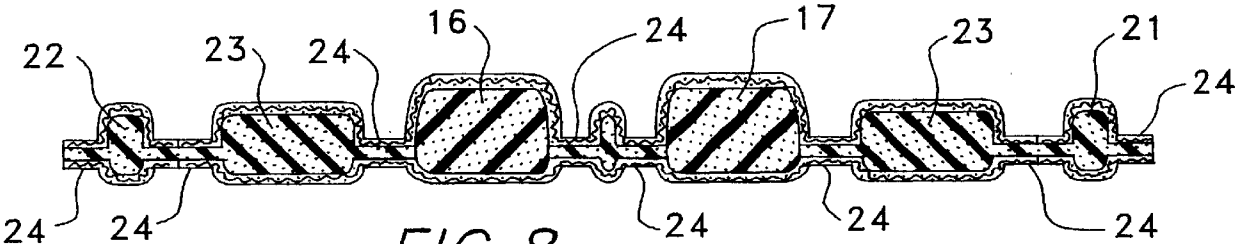
FIG. 8 is a section view of the chamois of FIGS. 1 and 3 taken on the line 8—8.

FIGS. 6, 7 and 8 are section views of male-use chamois 10 that are taken along the lines 6—6, 7—7 and 8—8 of FIG. 1. These three figures perhaps best show the relative thickness of the chamois' various foam pads and heat-formed line areas 24.

Figure 3:
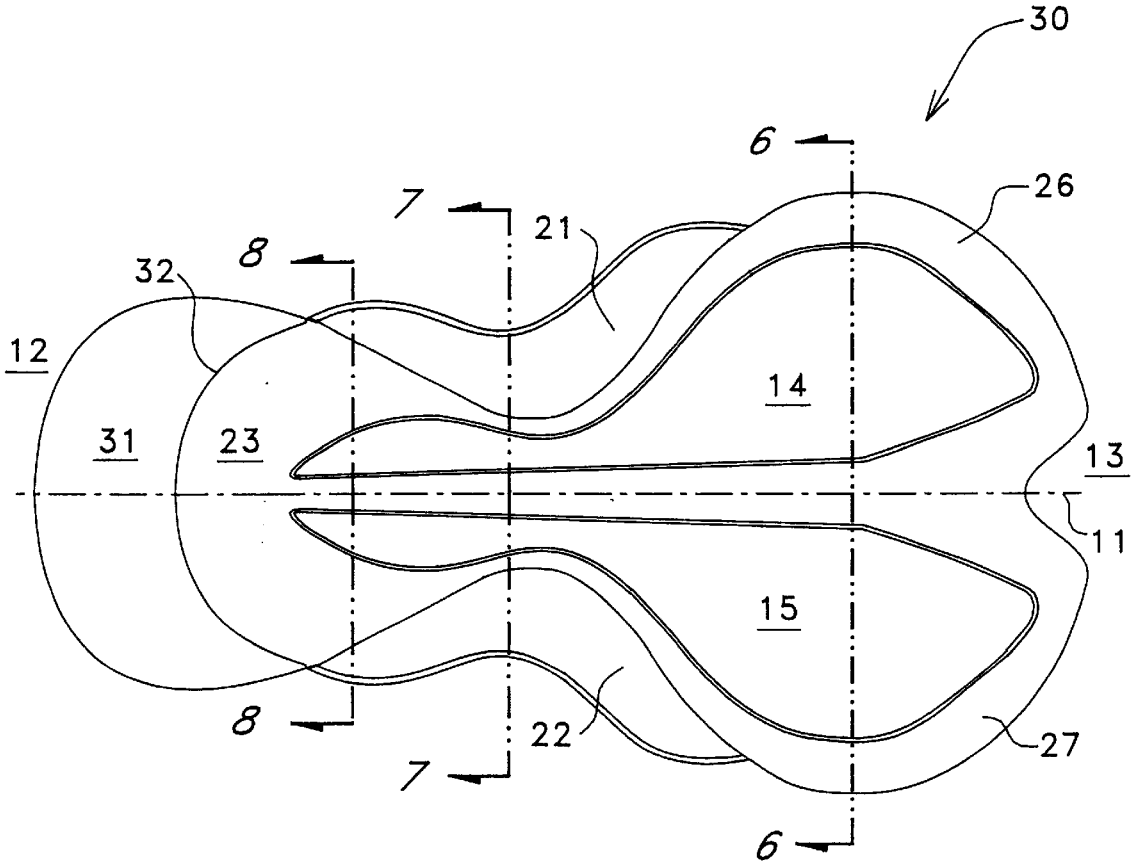
FIG. 3 is a body-side view of another embodiment of the invention for use by a male cyclist, this embodiment being generally similar to FIG. 1, but including an additional thin-foam pad that is stitched to the forward or lower-abdominal edge of the FIG. 1 chamois.

FIG. 3 is a body-side view of a chamois 30 in accordance with the invention that is constructed and arranged for use by a male cyclist. Chamois 30 is similar to above-described chamois 10, with the exception that an additional lower-abdominal pad 31 has been stitched or heat attached to the forward edge 32 chamois 30. Pad 31 contains a sheet of relatively thin and low-hardness foam, as was described above relative to pads 21, 22, 23, 26 and 27.

Figure 4:
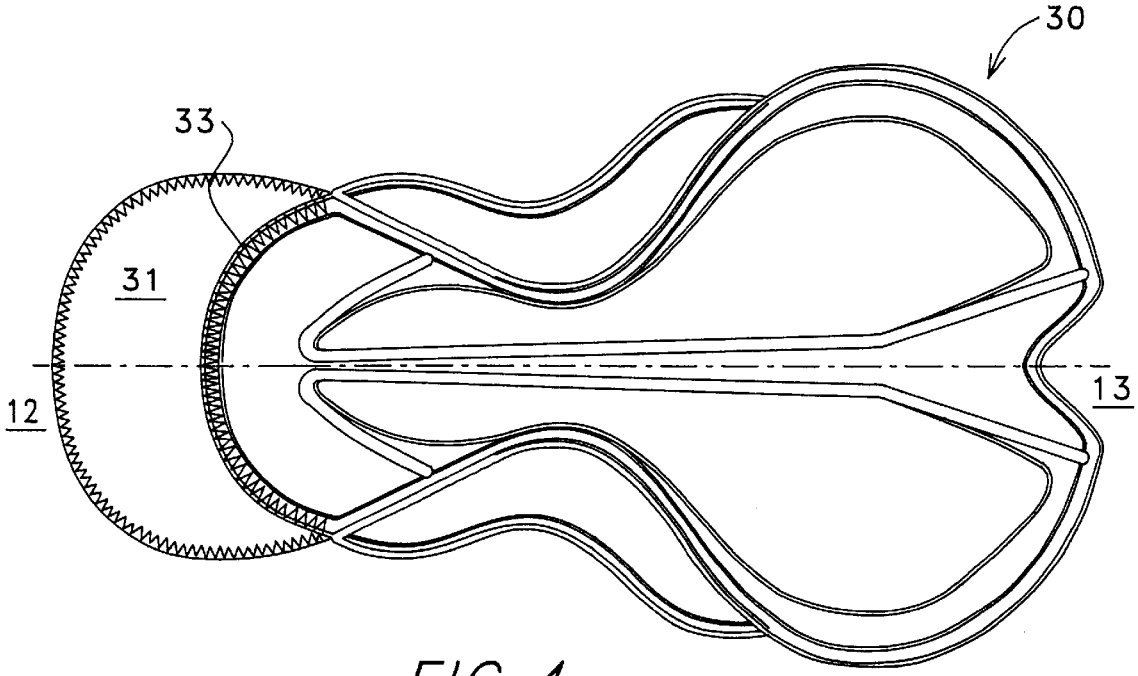
FIG. 4 is a garment-side view of the FIG. 3 male-cyclist chamois.

FIG. 4 is a garment-side view of FIG. 3 chamois 30, this figure showing that pad 31 has been stitched at 33 to the forward end 32 of chamois 30.

FIGS. 6, 7 and 8 are section views of chamois 30 that are taken along the lines of 6—6, 7—7 and 8—8 of FIG. 3. These three figures perhaps best show the relative thickness of the chamois' various foam pads and heat-formed line areas 24.

Figure 5:
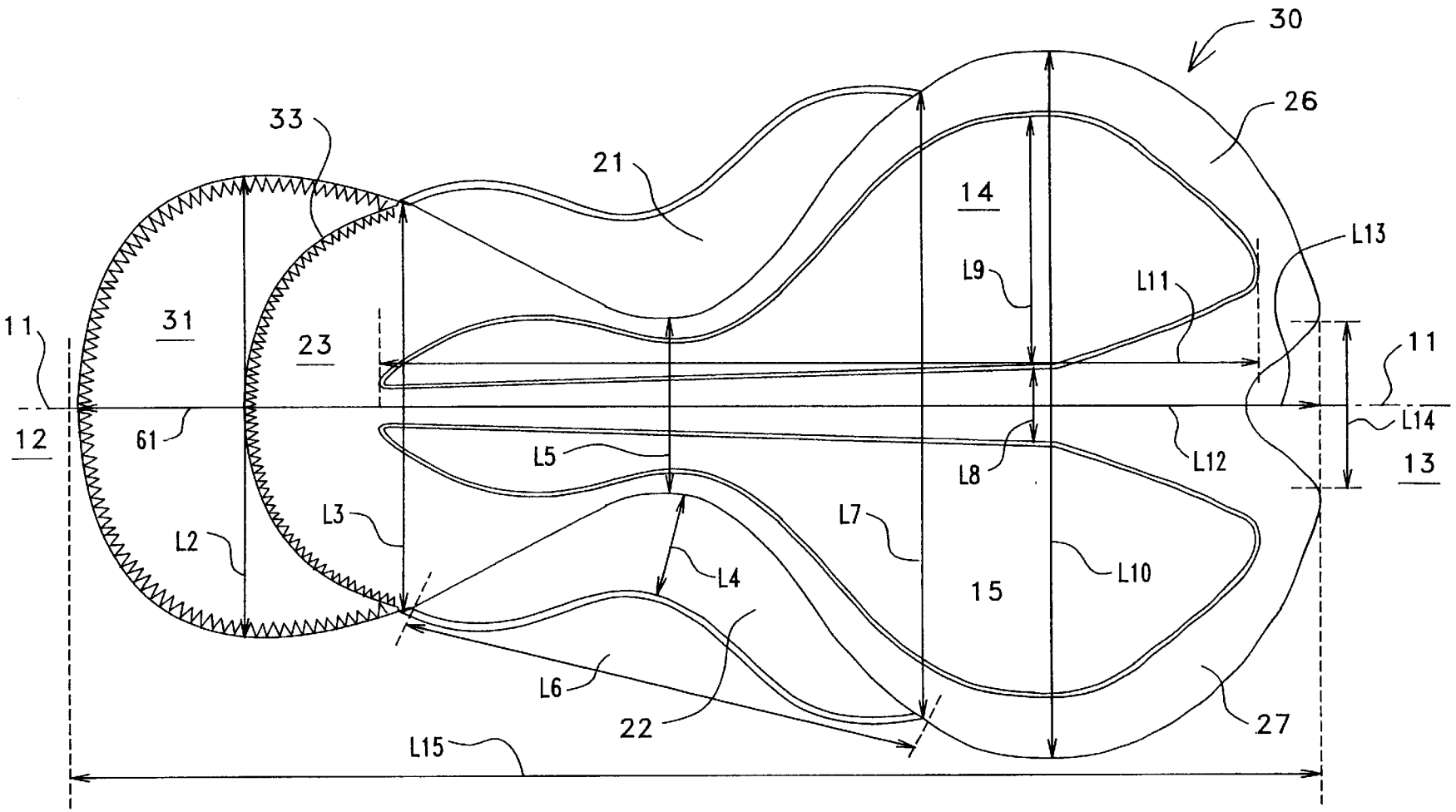
FIG. 5 is a view similar to FIG. 4 that is useful to identify exemplary and non-limiting dimensions of portions of the chamois, these dimensions being typical of embodiments of the invention intended for use by a male cyclist.

FIG. 5 is a view similar to FIGS. 3 and 4 that is useful in identifying exemplary and non-limiting physical dimensions of portions of chamois 30, these dimensions being typical of a chamois 10 or 30 in accordance with the invention that are for use by a male cyclist.

Figure 15:
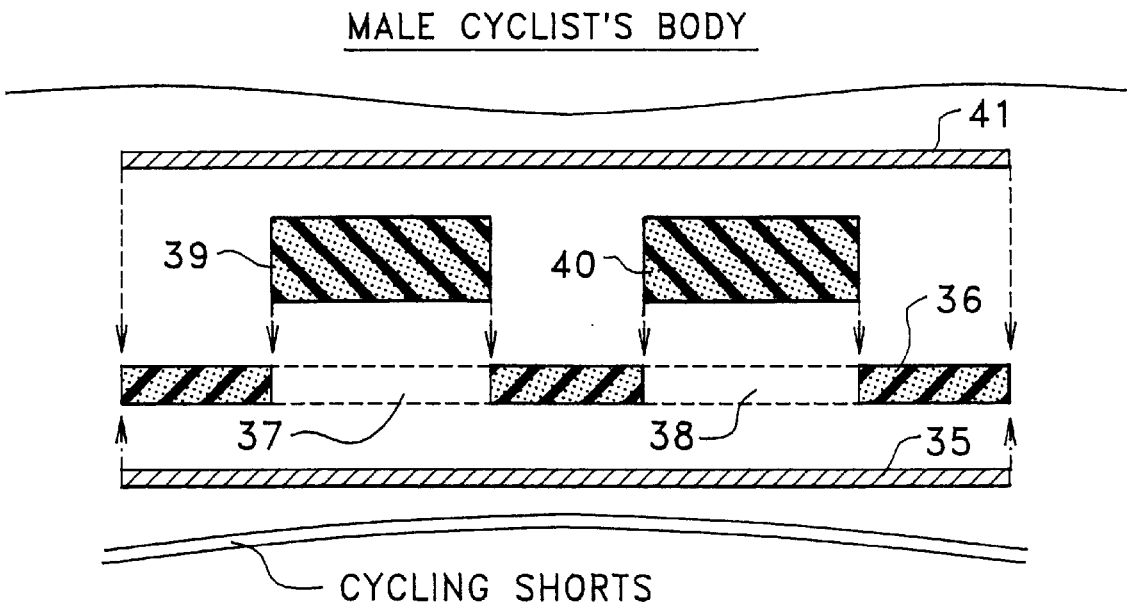
FIG. 15 is an exploded side view of a portion of male-use chamois of the invention wherein the chamois is assembled from five pieces that include (piece 1) a garment-side cloth member, (piece 2) a sheet of thin and low-hardness foam having two through-holes cut therein that complement the shape of (pieces 3 and 4) two pieces of thick and high-hardness foam, each piece of thick foam closely fitting within a through-hole that is formed in the sheet of thin foam, and (piece 5) a body-side cloth member.

FIG. 15 is an exploded side view of a portion of a male-use chamois 10 and 30 in accordance with the invention, this figure showing how the chamois is assembled from five pieces that include a garment-facing cloth member 35, a sheet 36 of relatively thin and low-hardness foam that has the same outer shape as garment-side cloth member 35, and that has two through-holes 37 and 38 cut therein in order to form two holes 37, 38 that complement the outer shape of two pieces 39 and 40 of thick and high-hardness foam, each piece 39, 40 of thick foam closely fitting within a through-hole 37, 38 that is formed in thin foam sheet 36, and a body-facing cloth member 41.

As a feature of the invention, body-facing cloth member 41 is formed of a synthetic leather (for example, of the brand ALCANTARA), garment-facing cloth member 35 is formed of a polyester, preferably a wicking polyester, thin foam layer 36 is about 6 mm thick and has a hardness of about 20 d, and each of the two thick foam pieces 39, 40 is about 12 mm thick and has a hardness in the range of from about 40 d to about 90 d.

Figure 17:
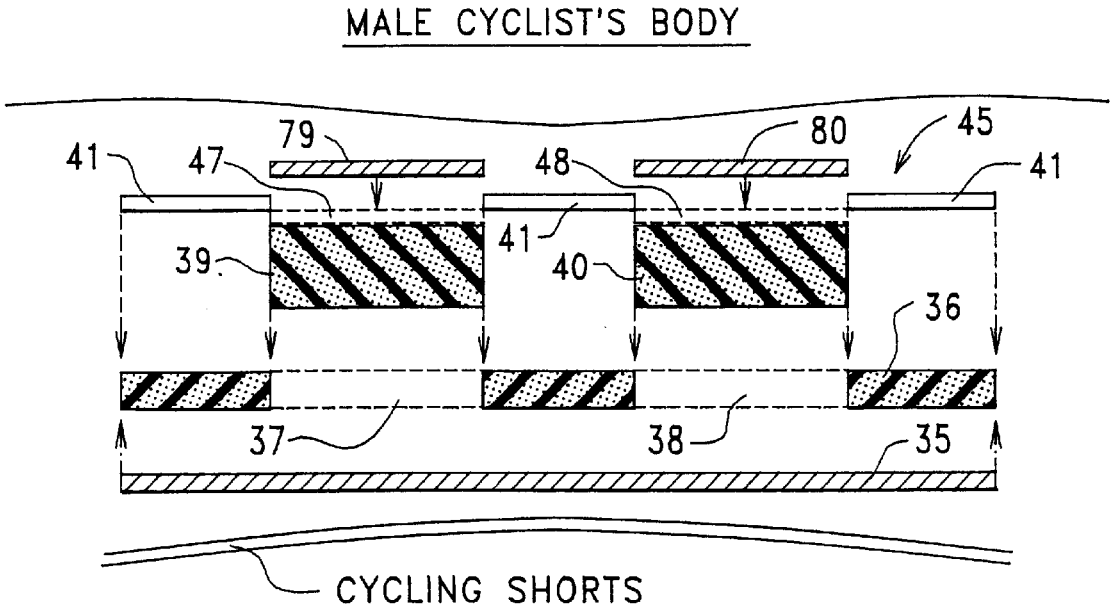
FIG. 17 is an exploded side view of a portion of a male-use chamois of the invention wherein the chamois is assembled from seven pieces that include (piece 1) a body-facing cloth member having two generally tear-drop shaped through-holes formed therein that directly overly two generally tear-drop shaped thorough-holes that are formed in (piece 2) a thin and low-hardness foam layer and (pieces 3 and 4) two thick and high-hardness foam pieces, each of the two through-holes in the body-facing cloth member being filled by (pieces 5 and 6) a piece of similarly shaped synthetic leather that directly overlies one of the two pieces of thick foam, and including (piece 7) a garment-facing cloth member.

FIG. 17 shows another embodiment of the invention wherein a male-use chamois 45 comprises seven pieces that include a body-facing cloth member 41 that is formed of a wicking polyester, and includes two generally tear-drop shaped through-holes 47 and 48 that are formed therein so as to directly overly two generally tear-drop shaped through-holes 37 and 38 that are formed in a thin and low-hardness foam layer 36. Each of the two through-holes 47, 48 within body-facing cloth member 41 are then filled by a piece of similarly shaped and similar thickness synthetic leather 79, 80 that individually directly overlie one of the two pieces 39, 40 of thick foam.

Figure 19:
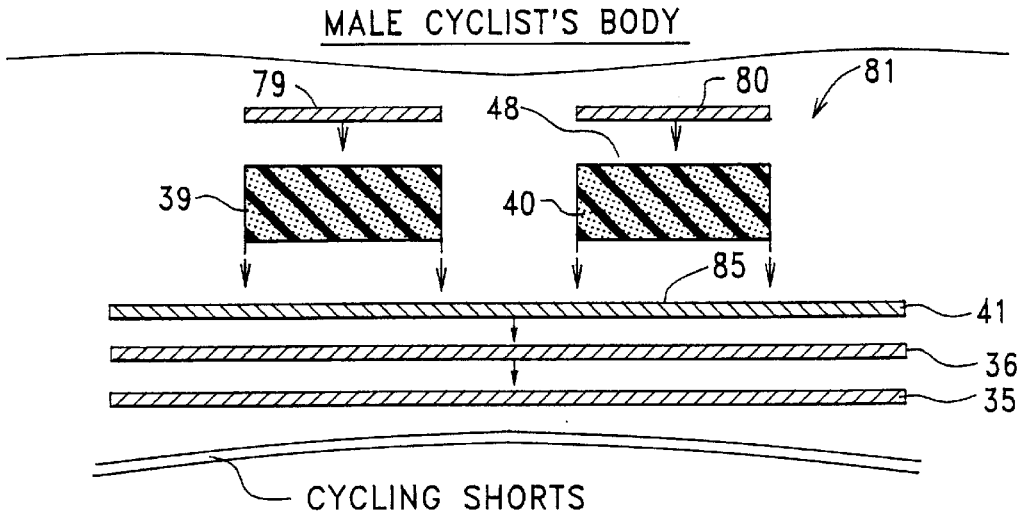
FIG. 19 is an exploded view of a male-use chamois in accordance with the invention wherein the chamois is assembled from seven pieces that include (piece 1) a continuous garment-facing cloth member, (piece 2) a continuous sheet of thin and low-hardness foam that overlies the garment-facing cloth member, (piece 3) a continuous body-facing cloth member that overlies the low-hardness foam sheet and that has two tear-drop shaped areas thereon that carry (pieces 4 and 5) two generally tear-drop shaped thick and high-hardness foam pieces, each of the thick foam pieces carrying (pieces 6 and 7) a piece of synthetic leather.

FIG. 19 shows another embodiment of the invention wherein a male-use chamois 81 comprises seven pieces that include a continuous garment-facing cloth member 35, a continuous low-hardness foam layer 36, a continuous body-facing cloth member 41 that is preferably formed of a synthetic wicking polyester (i.e., a warp knit polyester tricot with a wicking finish) that includes two generally tear-drop shaped areas 84 and 85 thereon that each receive a piece 39, 40 of similarly shaped, thick, and high-harness foam 39 and 40, with the top surfaces of thick foam pieces each individually receiving a piece of synthetic leather 79, 80.

The top and bottom views of chamois 81 are generally identical to FIGS. 1 and 2 with the exception that stitching 25 of FIG. 2 is not provided on chamois 81. Chamois 81 does, however, include weld lines 24.

Figure 21:
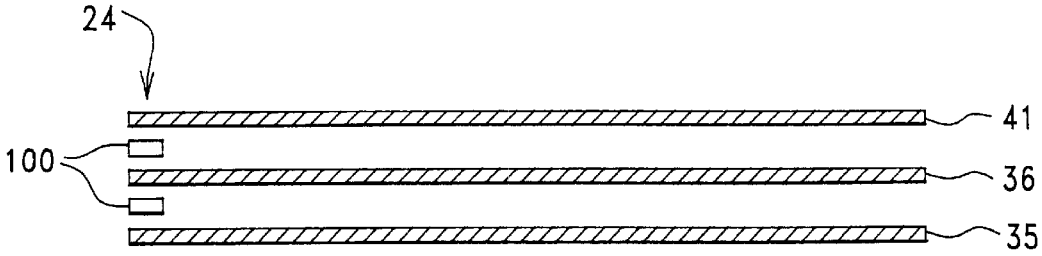
FIG. 21 is an exploded view that shows how weld lines operate to bind layers of the chamois of the invention together by placing a thin ribbon of heat-meltable plastic intermediate adjacent chamois layers, such that when the chamois assembly is thereafter placed within a heat press, the plastic ribbon melts and binds the chamois assembly together as a thin weld lines are concomitantly formed.

FIG. 21 is an exploded view that shows how the weld lines 24 that bind the edges of body-facing cloth member 35, this foam layer 36, and garment-facing cloth member 41 are formed by placing thin ribbons 100 of heat-meltable plastic intermediate layers 35 and 36 and intermediate layers 36 and 41. When the FIG. 21 assembly 35, 36, and 41 is placed within a heat-press, ribbons 100 melt and bind the edges of the assembly together as a thin weld line 24 is formed.

This or another heat/pressure process can also be used to form chamois 81 into a three-dimensional shape that approximates the pelvic girdle of a male cyclist. As a result, chamois 81 is devoid of stitching and the like.

An important feature of the FIG. 19 embodiment of the invention is that a first large-size sheet can be formed that comprises the three layers 35, 36, 41, and a second large-size sheet can be formed that comprises the two layers 39, 40 and 79, 80. Preferably, the layers of the first and second multi-layer sheets are bonded together to thereby form two unitary sheets that are relatively easy to handle during manufacture of a chamois in accordance with the invention.

The first three-layer sheet can be then stamped or cut to form a plurality of individual three-layer pieces 41, 36, 35 (FIG. 19) that are each of the overall chamois shape that is shown in FIG. 1. In addition, the second two-layer sheet can then be stamped, or cut to form a first plurality of tear-drop shaped individual pieces 79, 39 (FIG. 19) that are of the thick-pad shape 14 that is shown in FIG. 1, and the second two-layer sheet can also be stamped or cut to form a second plurality of tear-drop shaped individual pieces 80, 40 (FIG. 19) that are of the thick pad shape 15 that is shown in FIG. 1.

A single chamois 81 can then be formed by using one of the three-layer chamois-shaped pieces, by using one of the two layer thick pad shapes 14, and by using one of the two-layer thick-pad-shapes 15.

Figure 9:
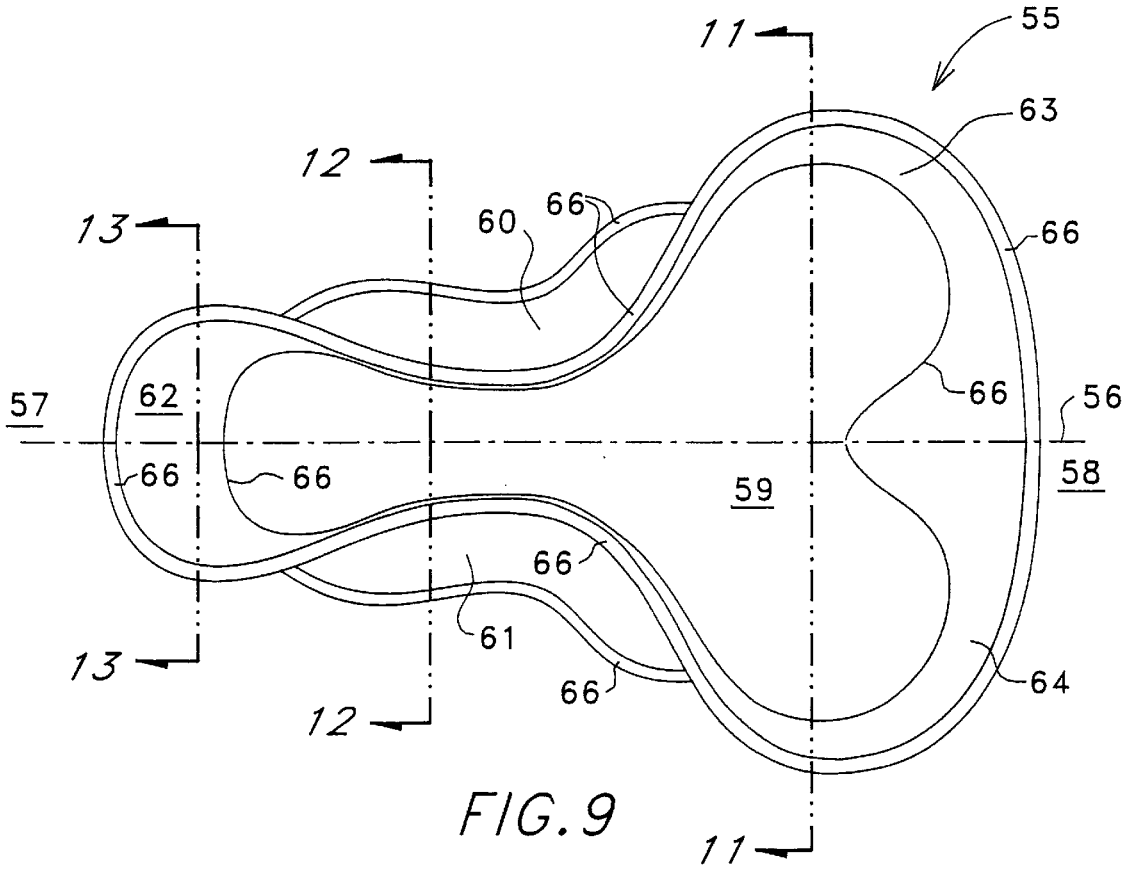
FIG. 9 is a body-side view of another embodiment of a chamois in accordance with the invention that is constructed and arranged for use by a female cyclist.

Turning now to a description of chamois in accordance with the invention that are constructed and arranged for use by a female cyclist, FIG. 9 is a body-side view of a chamois 55 in accordance with the invention wherein chamois 55 is constructed and arranged for use by a female cyclist. Chamois 55 is symmetrical about a front-to-back centerline 56, the forward end of chamois 55 being indicated by numeral 57, and the rearward end of chamois 55 being indicated by numeral 58.

Figure 11:
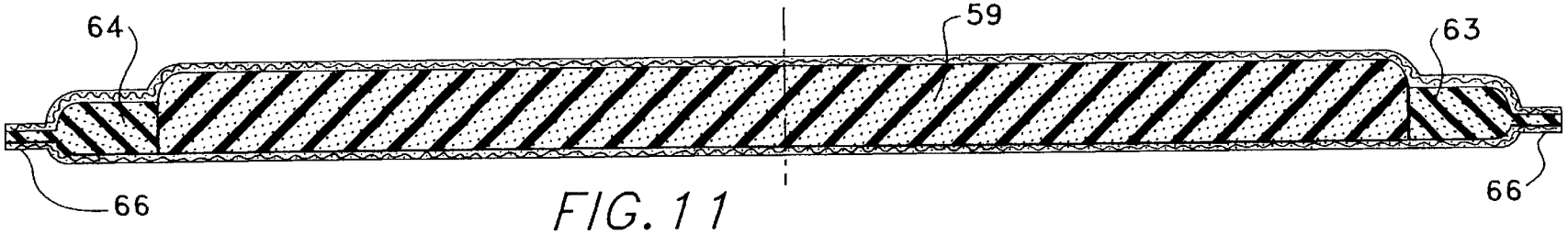
FIG. 11 is a section view of the chamois of FIG. 9 taken on the line 11—11.
Figure 12:
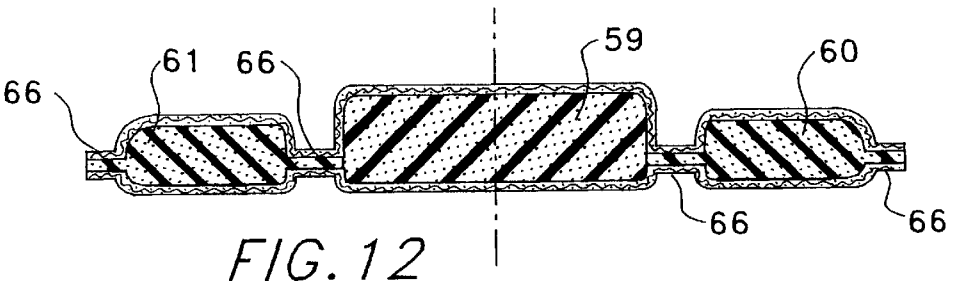
FIG. 12 is a section view of the chamois of FIG. 9 taken on the line 12—12.

Chamois 55 includes one relatively thick and high-hardness foam pad area 59 that is generally of an elongated heart-shape. Thick pad area 59 is provided by a piece of relatively high-hardness foam, as discussed above, that is contained internally of chamois 55, as shown in FIGS. 11 and 12. Thick pad area 59 is symmetrical about centerline 56 and it is adapted to support the right buttocks, the left buttocks and the crotch area of a female cyclist.

Again by way of a non-limiting example, thick pad area 59 is about 12 mm thick, and the thick foam that forms pad area 59 has a durometer of about 40 d to about 90 d.

All chamois areas, with the exception of thick pad area 59, are formed by a sheet of relatively thin and low-hardness foam. By way of a non-limiting example, these other pad areas are about 6 mm thick, and the relatively thin foam that forms these other pad areas has a durometer of about 20 d.

These other relatively thin chamois pad areas include a right-side upper inside thigh pad 60, a left-side upper inside thigh pad 61, a forward lower-abdominal pad 62, and two rear pad areas 63 and 64 that generally surround the rear of thick foam pad 59.

Figure 10:
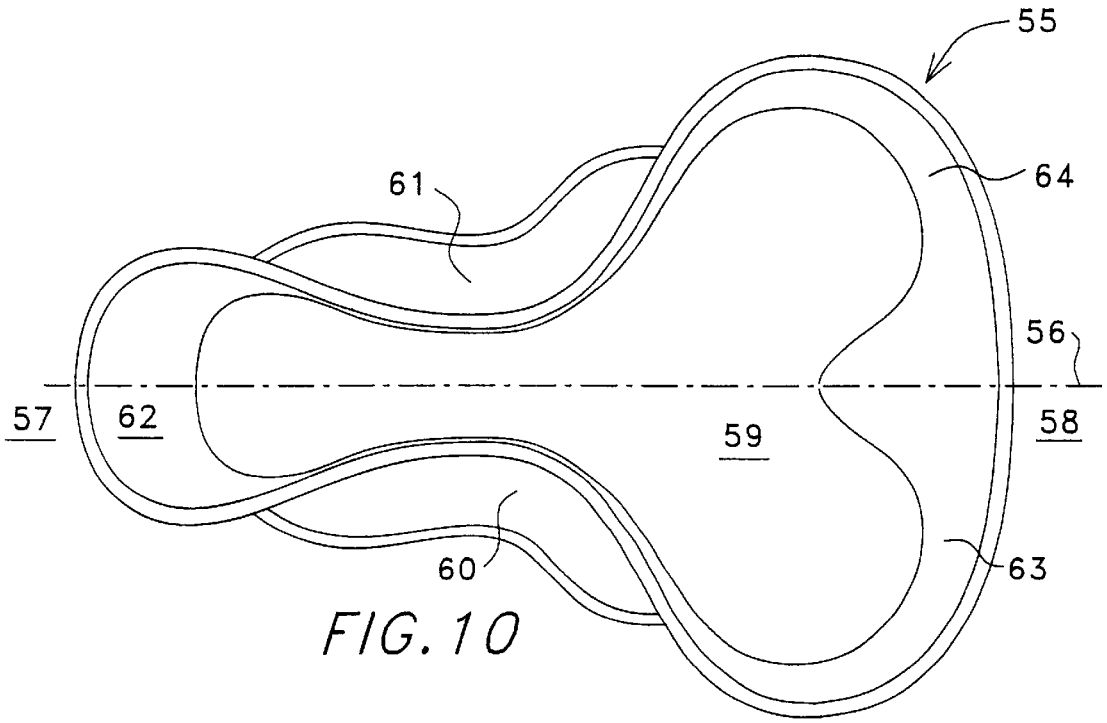
FIG. 10 is a garment-side view of the FIG. 9 chamois.

The various pad areas 59, 60, 61, 62, 63, and 64 of chamois 55 are outlined or surrounded by thin heat-formed lines 66 that are about 2 mm thick. FIG. 10 is a garment-side view of chamois 55.

Figure 13:
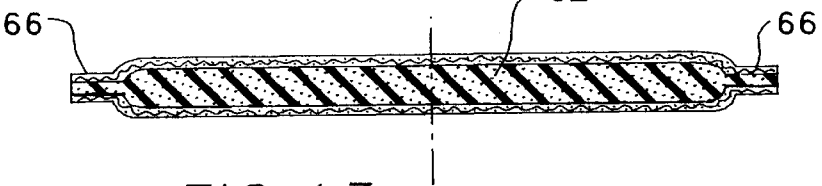
FIG. 13 is a section view of the chamois of FIG. 9 taken on the line 13—13.
Figure 14:
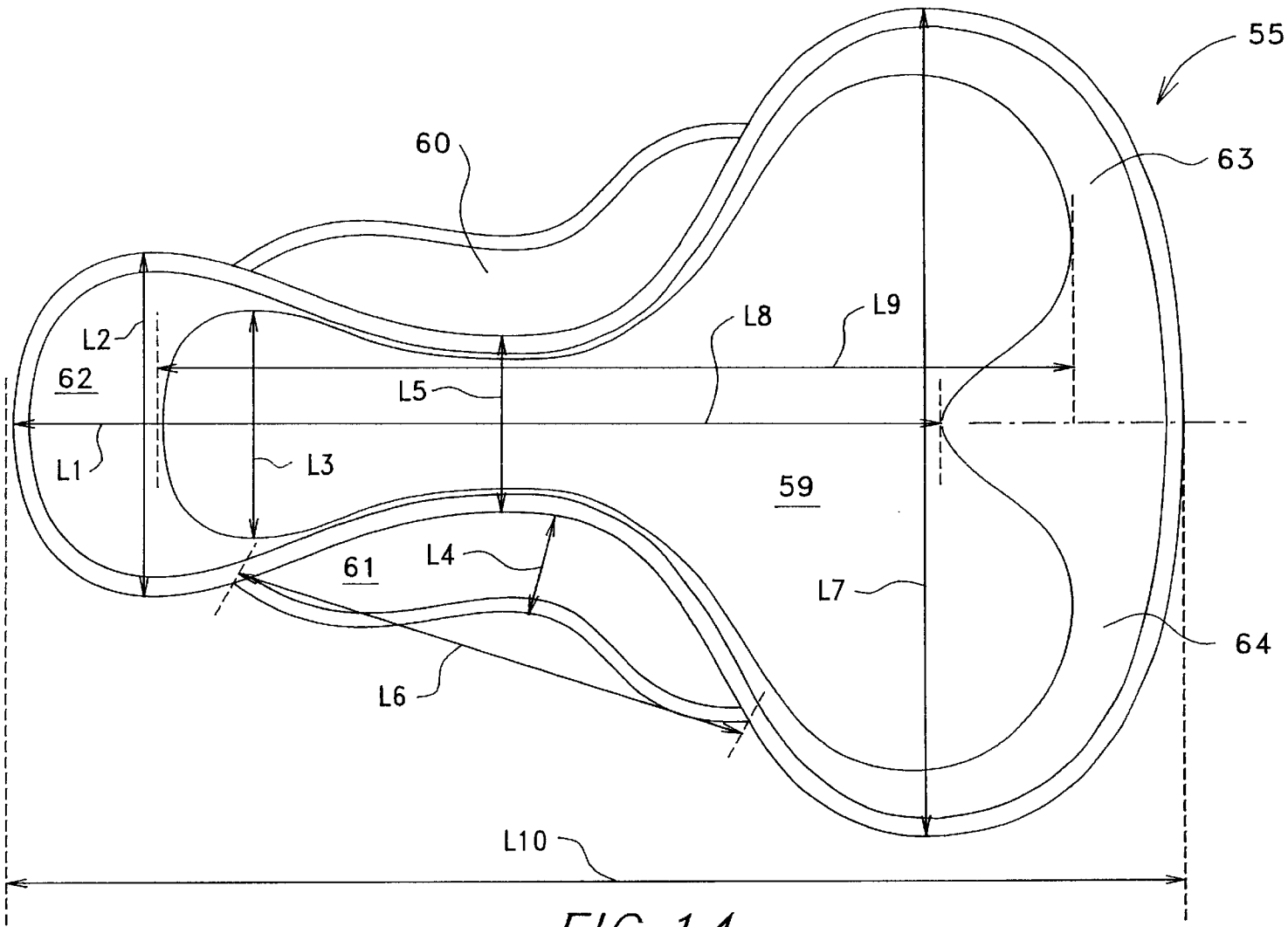
FIG. 14 is a view similar to FIG. 9 that is useful to identify exemplary and non-limiting dimensions of portions of the chamois, these dimensions being typical of embodiments of the invention for use by a female cyclist.

FIGS. 11, 12 and 13 are section views of chamois 55 that are taken along the lines 11—11, 12—12 and 13—13 of FIG. 9. These three figures perhaps best show the relative thickness of the chamois' various pad areas 59, 60, 61, 62, 63, and 64, and the heat-formed lines 66 that outline or boarder these pad areas. FIG. 14 is a view that is useful to identify exemplary and non-limiting physical dimensions of portions of female-use chamois 55, these dimensions being typical of a chamois 55 in accordance with the invention for use by a female cyclist.

Figure 16:
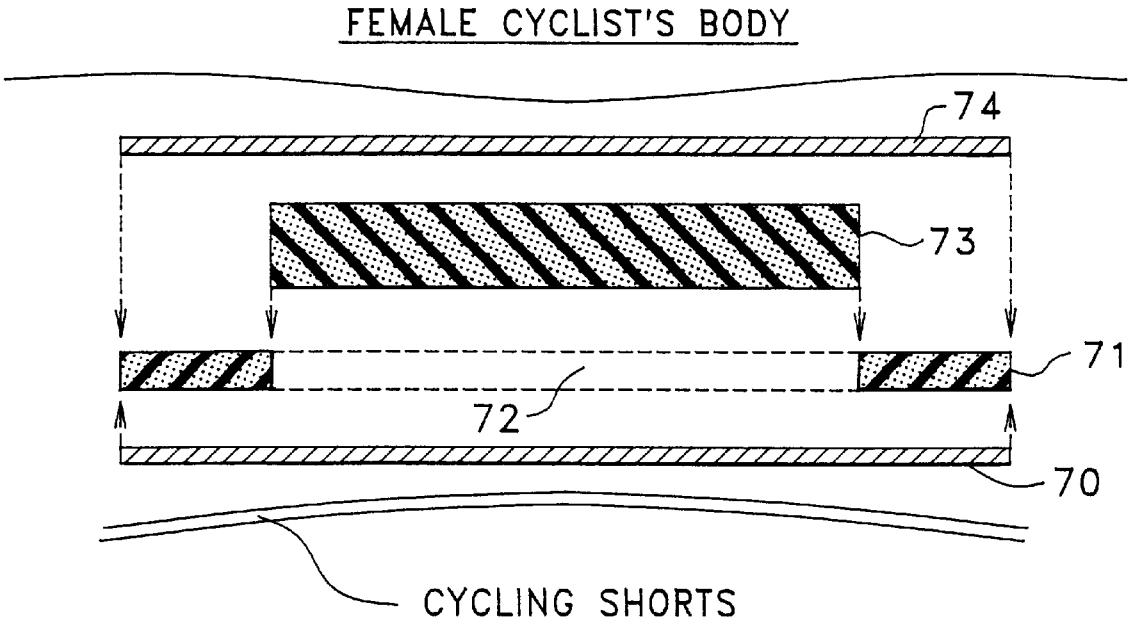
FIG. 16 is an exploded side view of a portion of a female-use chamois of the invention wherein the chamois is assembled from four pieces that include (piece 1) a garment-side cloth member, (piece 2) one sheet of thin and low-hardness foam and having one through-hole cut therein that complements the outer shape of (piece 3) a sheet of relatively thick and high-harness foam, this sheet of thick foam closely fitting within the through-hole that is formed in the sheet of thin foam, and (piece 4) a body-side cloth member.

FIG. 16 is an exploded view of a portion of a female-use chamois 55 in accordance with the invention showing how chamois 55 is assembled from four pieces that include (piece 1) a garment-side cloth member 70, (piece 2) a sheet 71 of relatively thin and low-hardness foam 71 having the same outer shape as garment-side cloth member 70 and having one through-hole 72 that is cut therein that complements the outer shape of (piece 3) a piece 73 of thick and high-hardness foam, wherein piece 73 of thick foam closely fits within the through-hole 72 that is formed in the sheet 71 of thin foam, and (piece 4) a body-side cloth member 74.

As a feature of the invention, body-side cloth member 74 is formed of a synthetic leather and/or garment-side cloth member 70 is formed of a polyester, preferably a warp knit polyester tricot having a wicking finish, thin foam layer 71 is about 6 mm thick and has a hardness of about 20 d, and thick foam piece 73 is about 12 mm thick and has a hardness of from about 40 d to about 90 d.

Figure 18:
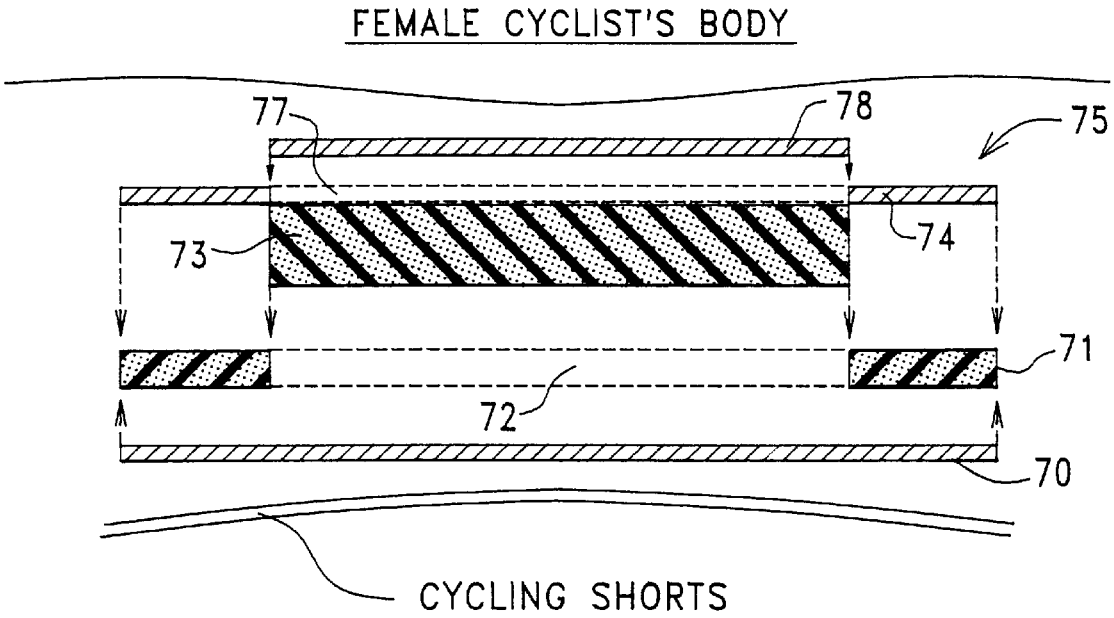
FIG. 18 is an exploded view of a portion of a female-use chamois of the invention wherein the chamois is assembled from five pieces that include (piece 1) a body-facing cloth member that has one through-hole formed therein that directly overlies a through-hole that is formed in (piece 2) a thin and low-hardness foam layer, the through-hole in the body-facing cloth member being filled by (piece 3) a piece of similarly-shaped synthetic leather that directly overlies (piece 4) a piece of thick and high-harness foam, and including a garment facing cloth member (piece 5).

FIG. 18 shows an embodiment of the invention wherein a female-use chamois 75 is a five-piece chamois having a body-facing cloth member 74 that is formed of a wicking polyester that includes a through-hole 77 that is formed therein so as to directly overly a thorough-hole 72 that is formed in thin and low-hardness foam layer 71. The through-hole 77 within body-facing cloth member 74 is then filled by a piece 78 of similarly shaped and similar thickness synthetic leather that directly overlies a piece 73 of thick and high-hardness foam. Again chamois 75 of FIG. 18 is held together by an adhesive and/or by heat sealing.

Figure 20:
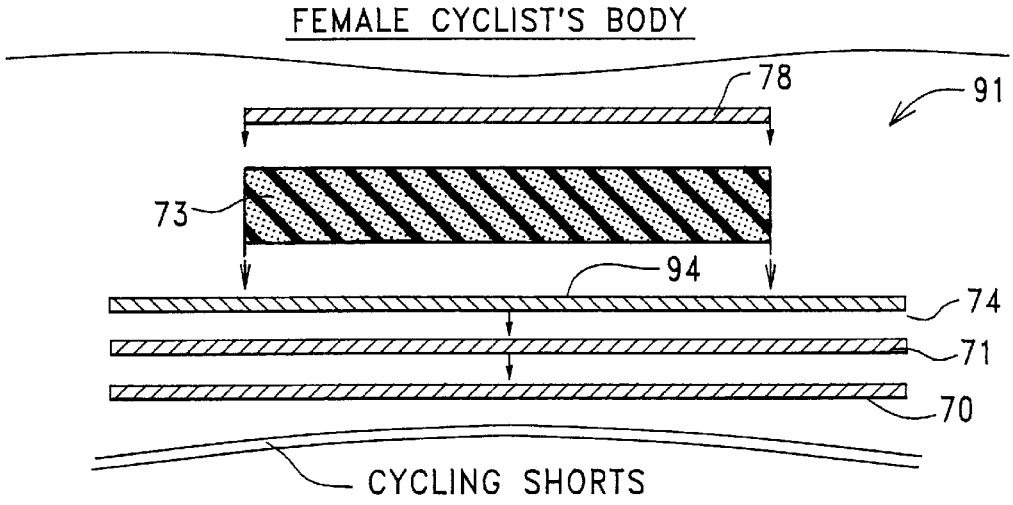
FIG. 20 is an exploded view of a female-use chamois in accordance with the invention wherein the chamois is assembled from five pieces that include (piece 1) a continuous garment-facing cloth member, piece 2) a continuous sheet of thin and low-hardness foam that directly overlies the garment-facing cloth member, (piece 3) a continuous body-facing cloth member that directly overlies the low-hardness foam sheet and that has an area thereon that carries (piece 4) a piece of thick and high-hardness foam, the thick foam piece carrying (piece 5) a piece of synthetic leather.

FIG. 20 shows an embodiment of the invention wherein a female-use chamois 91 comprises a five-piece synthetic chamois having a continuous garment-facing cloth member 70, a continuous thin and low-hardness foam layer 71, a continuous body-facing cloth member 74 that includes one elongated and heart-shaped area 94 that receives a heart-shaped piece of thick and high-hardness foam 73, and a heart-shaped piece of synthetic leather 78 that directly overlies thick foam piece 73.

The top and bottom views of chamois 91 are generally identical to FIGS. 9 and 10. Chamois 91 includes weld lines 66 that are preferably formed as was above described relative to FIG. 21 wherein the heat/pressure process can also be used to form chamois 91 into a three-dimensional shape that approximates the pelvic girdle of a female cyclist. As a result, chamois 91 is devoid of stitching and the like.

An important feature of the FIG. 20 embodiment of the invention is that a first large size sheet can be formed that comprises the three layers 70, 71, 74, and a second large size sheet can be formed that comprises the two layers 73 and 78. Preferably, the first three-layer sheet and the second two-layer sheet are layer bonded so as to form unitary three-layer and two-layer sheet assemblies.

The first three-layer sheet assembly can be then stamped or cut to form a plurality of individual three-layer pieces that are each of the overall chamois-shape that is shown in FIG. 9. In addition, the second two-layer sheet assembly can then be stamped or cut to form a plurality of heart-shaped pieces that are of the thick pad shape 59 that is shown in FIG. 9.

A single chamois 91 can then be formed by using one of the three-layer chamois-shaped pieces and by using one of the two-layer heart-shaped pieces.

While physical dimensions of chamois in accordance with this invention are not to be construed as a limitation on the spirit and scope of the invention, FIG. 5 shows various dimensions of male-use chamois in accordance with the invention, these dimensions being shown in the following Table 1. In this male-use embodiment of the invention, the chamois had a major width L10 of 205 mm and a major length L15 of 355 mm.

TABLE 1

| | |
|---|---|
| Dimension L1 | 55 mm |
| Dimension L2 | 115 mm |
| Dimension L3 | 105 mm |
| Dimension L4 | 50 mm |
| Dimension L5 | 60 mm |
| Dimension L6 | 140 mm |
| Dimension L7 | 180 mm |
| Dimension L8 | 20 mm |
| Dimension L9 | 75 mm |
| Dimension L10 | 205 mm |
| Dimension L11 | 245 mm |
| Dimension L12 | 265 mm |
| Dimension L13 | 35 mm |
| Dimension L14 | 55 mm |
| Dimension L15 | 355 mm |

FIG. 14 shows various dimensions of a female-use chamois in accordance with the invention, these dimensions being shown in the following Table 2. In this female-use embodiment of the invention, the chamois had a major width L7 of 210 mm and a major length L10 of 290 mm.

TABLE 2

| | |
|---|---|
| Dimension L1 | 45 mm |
| Dimension L2 | 90 mm |
| Dimension L3 | 65 mm |
| Dimension L4 | 45 mm |
| Dimension L5 | 50 mm |
| Dimension L6 | 145 mm |
| Dimension L7 | 210 mm |
| Dimension L8 | 200 mm |

TABLE 2-continued

| | |
|---|---|
| Dimension L9 | 220 mm |
| Dimension L10 | 290 mm |

One manner in which the various cloth/foam/leather layers/pieces of chamois in accordance with the present invention can be formed into a single unitary chamois assembly is to provide these various members as synthetic members (i.e., as members that are formed by chemical synthesis), and to then fuse these synthetic members together by the application of heat and pressure, perhaps in the presence of a bonding agent such as an adhesive. When such a heat/pressure process is used to fuse the various chamois layers/pieces together, the resulting chamois is devoid of stitching and the like.

In addition, such a heat/pressure bonding process (perhaps with the additional use of a heat-setting adhesive) can be accomplished by a hot press that additionally operates to emboss the above-described thin lines that outline the various areas of the chamois. In addition, a heat-meltable plastic ribbon can be used intermediate the layers, and at the location of the thin lines that outline the various areas of the chamois as above described relative to FIG. 21.

For example, a RF welding process may be used to fuse the various layers and pieces of the chamois together into a unitary chamois assembly, and a RF welding processes may also be used to form the chamois' thin seam-like lines.

As a feature of the invention, a heat-forming process can then be used to form the unitary chamois assembly into a three-dimensional shape that generally conforms to the pelvic girdle of a male or a female cyclist.

The present invention has been described in detail while making reference to various embodiments thereof. However, since it is known that others skilled in the related art will, upon learning of this invention, readily visualize yet other embodiments that are within the spirit and scope of this invention, the above detailed description is not to be taken as a limitation on the spirit and scope of this invention.

What is claimed is:

1. The method of making a chamois for use within the seat area of a cycling garment comprising:

providing a first planar and flexible cloth-like member having a bottom surface for engagement with the cycling garment;

forming said first cloth-like member into a shape that provides an enlarged area at one end for association with the buttocks of a cycling individual, that provides two side areas for association with the upper inside thighs of the individual, and that provides an area at an opposite end for association with the lower abdominal area of the individual;

providing a planar, flexible and thin foam-like member having a relatively low hardness property;

forming said thin foam-like member into a shape that complements said shape of said first cloth-like member;

placing a bottom surface of said thin foam-like member into engagement with a top surface of said first cloth-like member;

forming at least one pad area on said thin foam-like member to be associated with the buttocks of the individual;

providing at least one planar, flexible and thick foam-like member having a relatively high hardness property;

forming said at least one thick foam-like member into a shape that complement said shape of said at least one pad area on said thin foam-like member;

placing said at least one thick foam-like member on said at least one pad area on said thin foam-like member;

providing a second planar and flexible cloth-like member;

forming said second cloth-like member into a shape that complements said shape of said first cloth-like member;

placing a bottom surface of said second cloth like member into engagement with a top surface of said at least one thick foam-like member and a top surface of said thin foam-like member; and bonding said first cloth-like member, said thin foam-like member, said at least one thick foam-like member, and said second cloth-like member together as a unitary chamois assembly.

2. The method of claim 1 including the step of:

forming said unitary chamois assembly into a three-dimensional shape that approximates the pelvic girdle of the individual.

3. The method of claim 1 wherein said second cloth-like member is wickable polyester, and including the steps of:

forming at least one opening in said wickable polyester;

placing said at least one opening in said wickable polyester to overlay said at least one pad area on said thin foam-like member;

providing at least one synthetic leather member;

forming said at least one synthetic leather member into a shape that corresponds to said at least one opening in said wickable polyester; and placing said at least one synthetic leather member within said at least one opening in said wickable polyester.

4. The method of claim 3 including the step of:

forming said unitary chamois assembly into a three-dimensional shape that approximates the pelvic girdle of the individual.

5. A method of making a chamois for use within the seat area of a cycling garment to be worn by a mate cyclist, comprising:

providing a first planar and generally cloth-like member having a bottom surface for engagement with the cycling garment;

forming said first cloth-like member into a shape having two laterally-spaced buttocks pad areas for association with the buttocks of a male cyclist, having a crotch pad area intermediate said two buttocks pad areas for association with the crotch area of a male cyclist, having two inner thigh pad areas for association with the inner thighs of the male cyclist, and having a lower abdominal pad area for association with the lower abdominal area of the male cyclist;

providing a thin foam member having a relatively low hardness;

forming said thin foam member into a shape that complements said shape of said first cloth-like member;

providing two similarly-shaped through openings in said thin foam member for association with said two buttocks pad areas of said first cloth-like member;

placing a bottom surface of said thin foam member into engagement with a top surface of said first cloth-like member;

providing two thick foam members having a common and relatively high hardness;

forming each of said two thick foam members into a shape that complements said similar shape of said two openings in said thin foam member;

placing one of said two thick foam members within each of said two openings in said thin foam member;

providing a second cloth-like member;

forming said second cloth-like member into a shape that complements said shape of said first cloth-like member;

placing a bottom surface of said second cloth-like member into engagement with a top surface of said two thick foam members and a top surface of said thin foam member; and securing said first cloth-like member, said thin foam member, said two thick foam members, and said second cloth-like sheet together into a unitary chamois assembly.

6. The method of claim 5 including the step of:

forming said unitary chamois assembly into a three-dimensional shape that approximates the pelvic girdle of the male cyclist.

7. The method of claim 5 wherein said second cloth-like member is a wickable polyester including the steps of:

forming two similarly-shaped openings in said wickable polyester;

placing said two openings in said wickable polyester to overlay said two openings in said thin foam member;

providing two synthetic leather members;

forming each of said two synthetic leather members into a shape that corresponds to said two openings in said wickable polyester; and placing one of said two synthetic leathers member into each of said two openings in said wickable polyester.

8. The method of claim 7 including the step of:

forming said unitary chamois assembly into a three-dimensional shape that approximates the pelvic girdle of the male cyclist.

9. A method of making a chamois for use within the seat area of a cycling garment to be worn by a female cyclist comprising:

providing a first cloth-like member having a bottom surface for engagement with the cycling garment;

forming said first cloth-like member into a shape that provides one pad area for association with the buttocks and the crotch of a female cyclist, that provides two thigh pad areas for association with the inner thighs of the female cyclist, and that provides a lower abdominal pad area for association with the lower abdominal area of the female cyclist;

providing a thin foam member having a relatively low hardness;

forming said thin foam member into a shape that complements said shape of said first cloth-like sheet;

placing a bottom surface of said thin foam member into engagement with a top surface of said first cloth-like member;

providing a through opening in said thin foam member for association with said large pad area of said first cloth-like member;

placing a bottom surface of said thin foam member into engagement with a top surface of said first cloth-like member;

providing a thick foam member having a relatively high hardness;

forming said thick foam member into a shape that complements said shape of said opening in said thin foam member;

placing said thick foam member into said opening in said thin foam member;

providing a second cloth-like member;

forming said second cloth-like member into a shape that complements said shape of said first cloth-like sheet;

placing a bottom surface of said second cloth like sheet into engagement with a top surface of said thin foam member and a top surface of said thick foam member; and securing said first cloth-like member, said thin foam member, said thick foam member, and said second cloth-like sheet together as a unitary chamois assembly.

10. The method of claim 9 including the step of:

forming said unitary chamois assembly into a three-dimensional shape that approximates the pelvic girdle of the female cyclist.

11. The method of claim 9 wherein said second cloth-like member is a wickable polyester including the steps of:

forming an opening in said wickable polyester;

placing said opening in said wickable polyester to overlay said opening in said thin foam member;

providing a synthetic leather member;

forming said synthetic leather member into a shape that corresponds to said opening in said wickable polyester; and placing said synthetic leather member into said opening in said wickable polyester.

12. The method of claim 11 including the step of:

forming said unitary chamois assembly into a three-dimensional shape that approximates the pelvic girdle of the female cyclist.

13. The method of making a chamois for use within the seat area of a cycling garment comprising the steps of:

providing a first cloth-like sheet;

providing a thin foam sheet having a low hardness;

providing a second cloth-like sheet;

placing said thin foam sheet intermediate said first cloth-like sheet and said second cloth-like sheet to thereby form a three-sheet assembly;

binding said three-sheet assembly together to form a unitary three sheet assembly;

cutting said unitary three-sheet assembly into a plurality of three sheet pieces each having a shape of said chamois;

identifying an area within each of said three sheet pieces that is adapted to be associated with the buttocks area of a cyclist;

providing a thick foam sheet having a high hardness;

providing a third cloth-like sheet;

placing said thick foam sheet onto said third cloth-like sheet to thereby form a two-sheet assembly;

binding said two-sheet assembly together to form a unitary two sheet assembly;

cutting said unitary two-sheet assembly into a plurality of two sheet pieces each having a shape corresponding to said identified area within each of said three sheet pieces;

placing at least one of said two sheet pieces on one of said three sheet pieces with said thick foam sheet of said at least one two sheet pieces in physical engagement with said identified area within said three sheet piece; and binding said at least one two sheet piece to said one three sheet piece to form said chamois.

14. The method of claim 13 wherein said third cloth-like sheet is a sheet of synthetic leather.

15. The method of claim 13 wherein said thin foam sheet has a hardness of about 20 d, and wherein said thick foam sheet has a hardness in the range of from about 40 d to about 90 d.

16. The method of claim 13 including the step of:

forming said chamois into a three-dimensional shape approximating the shape of the pelvic girdle of a cyclist.

* * * * *